United States Patent [19]

Penkunas et al.

[11] Patent Number: 5,045,277

[45] Date of Patent: Sep. 3, 1991

[54] METHOD OF PRODUCING METAL CARBIDE GRADE POWDERS AND CONTROLLING THE SHRINKAGE OF ARTICLES MADE THEREFROM

[75] Inventors: Joseph J. Penkunas; Theodore E. Smith, Jr., both of Sayre, Pa.

[73] Assignee: GTE Products Corporation, Stamford, Conn.

[21] Appl. No.: 579,519

[22] Filed: Sep. 10, 1990

[51] Int. Cl.[5] ..... B22F 1/00

[52] U.S. Cl. ..... 419/15; 419/17; 419/18; 419/33; 419/65; 419/66; 75/252; 75/255

[58] Field of Search ..... 419/15, 17, 18, 33, 419/65, 66; 75/255, 252

[56] References Cited

U.S. PATENT DOCUMENTS

| | | | |
|---|---|---|---|
| 4,070,184 | 1/1978 | Scheithaver et al. | 75/203 |
| 4,849,165 | 7/1989 | Schaefer | 75/304 |
| 4,886,638 | 12/1989 | Penkunas et al. | 419/15 |
| 4,902,471 | 2/1990 | Penkunas et al. | 419/33 |

*Primary Examiner*—Stephen J. Lechert, Jr.

*Attorney, Agent, or Firm*—L. Rita Quatrini; Elizabeth A. Levy

[57] ABSTRACT

A method for producing metal carbide grade powders which comprises forming a wax mixture consisting essentially of in percent by weight about 5 to about 15 paraffin oil, with the balance being an esterified wax and paraffin, heating the wax mixture to a temperature above the melting point to melt the wax mixture and maintain it in the molten state, forming a powder-wax mixture consisting essentially of metal carbide powder, a binder metal, and the wax mixture while heating to a temperature above the melting point of the wax mixture to maintain the wax mixture in the molten state to result in a uniform distribution of the wax mixture on the carbide and binder metal particles, forming a slurry of the powder-wax mixture and water, attritor milling the slurry at a temperature below the melting point of the wax mixture, and removing water and agglomerating to produce metal carbide grade powder wherein a densified article made therefrom exhibits less linear shrinkage than articles made from carbide grade powder absent the esterified wax. The shrinkage decreases as the content of esterified wax in the wax mixture increases.

5 Claims, 1 Drawing Sheet

METHOD OF PRODUCING METAL CARBIDE GRADE POWDERS AND CONTROLLING THE SHRINKAGE OF ARTICLES MADE THEREFROM

BACKGROUND OF THE INVENTION

This invention relates to a method for producing metal carbide grade powders wherein the composition of the wax can be varied to control the linear shrinkage in sintered articles made from the powder.

Metal carbide grade powders are used in making sintered parts such as cutting tools, mining tools and wear parts. It is extremely important that the shrinkage be controlled during sintering to maintain the proper shape and size of the article.

In making carbide grade powders, there is normally a water milling step in which the powder is intimately mixed with a wax binder. In water milling, the binder metal, especially cobalt, is prone to oxidation and most metallic carbides will decarburize in water forming a methane-acetylene gas. These reactions produce powders with unbalanced chemistries. During subsequent sintering of the formed article, the loss of the oxygen volume in particular causes an increase in shrinkage. There is also a tendency of the wax to separate from the powder causing the grinding of the carbide crystals. This results in generation of excessive quantities of "fines" which are associated with increased shrinkage. Up to this time shrinkage was controlled by adjusting the conditions under which the powder was milled with the wax binder, such as length of time of milling, etc. However, varying milling conditions is not always advantageous because there is a possibility that other properties in the subsequently formed sintered and densified article, such as porosity, hardness, and microstructure, would be adversely affected.

Therefore it has become desirable to have a method of making carbide grade powders in which the shrinkage could be controlled without adversely affecting other properties in articles made from the powders, especially without having to vary milling conditions once the proper milling conditions have been set.

SUMMARY OF THE INVENTION

In accordance with one aspect of the invention, there is provided a method for producing metal carbide grade powders which comprises forming a wax mixture consisting essentially of in percent by weight about 5 to about 15 paraffin oil, with the balance being an esterified wax and paraffin, heating the wax mixture to a temperature above the melting point to melt the wax mixture and maintain it in the molten state, forming a powder-wax mixture consisting essentially of metal carbide powder, a binder metal, and the wax mixture while heating to a temperature above the melting point of the wax mixture to maintain the wax mixture in the molten state to result in a uniform distribution of the wax mixture on the carbide and binder metal particles, forming a slurry of the powder-wax mixture and water, attritor milling the slurry at a temperature below the melting point of the wax mixture, and removing water and agglomerating to produce metal carbide grade powder wherein a densified article made therefrom exhibits less linear shrinkage than articles made from carbide grade powder absent the esterified wax. The shrinkage decreases as the content of esterified wax in the wax mixture increases.

DETAILED DESCRIPTION OF THE INVENTION

Figure 1:
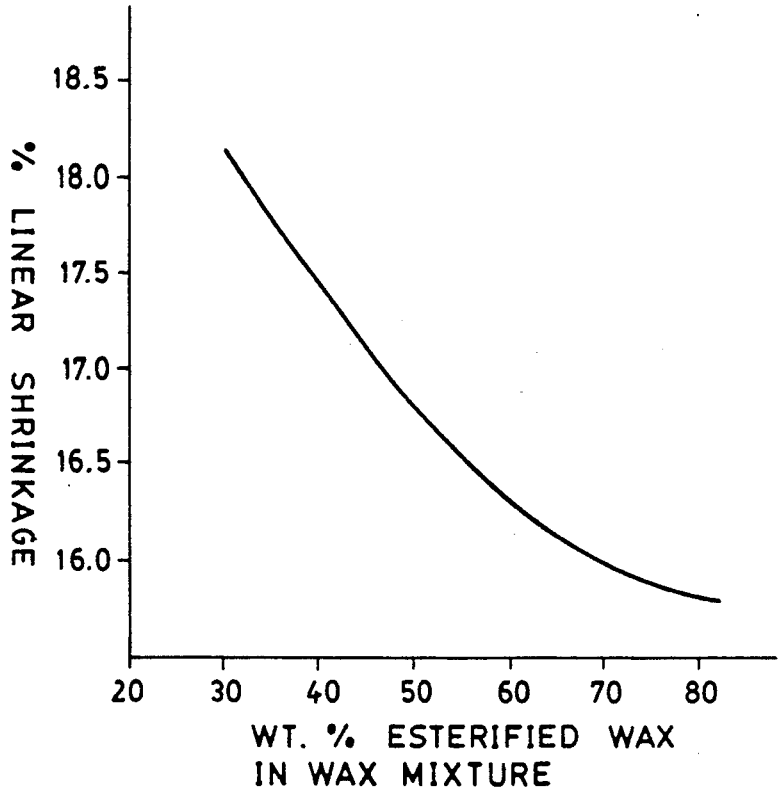
FIG. 1 is a plot of weight percent of esterified wax in the wax mixture versus the linear shrinkage in densified tungsten carbide-cobalt articles made from the powder.

For a better understanding of the present invention, together with other and further objects, advantages and capabilities thereof, reference is made to the following disclosure and appended claims in connection with the above described figure and description of some of the aspects of the invention.

The present invention provides a method for producing metal carbide grade powder in which the composition of the esterified wax component in the wax binder mixture can be varied to control the linear shrinkage in densified articles made from the powder. By increasing the amount of esterified wax in the wax composition the shrinkage decreases.

A wax mixture is formed consisting essentially of in percent by weight about 5 to about 15 paraffin oil, and the balance being an esterified wax and paraffin. The preferred paraffinic oils are low molecular weight, for example mineral oils. The paraffin oils are made part of the mixture to decrease the hardness of the wax mixture. The paraffin or paraffinic wax is refined having a melting point of about 50° C. to about 55° C. The esterified wax contains a C=O group and is normally solid at temperatures of about 20° C. to about 35° C. Some preferred esterified waxes are beeswax, carnauba wax, candellila wax, and combinations of these. The esterified wax is made part of the wax mixture to increase the functionality of the wax mixture. The electrons available in the C=O group of the esterified wax are able to form hydrogen bonds with the carbide-metal powder particle surfaces. The coating of the carbide-metal powder particle surfaces is done with the wax mixture in the molten state so that the molecules can move and rotate enabling the C=O group to come in contact with the carbide-binder metal particle surfaces. The wax coats the particles and remains bound to the powder surfaces thereby minimizing fracture of the powder particles. This is in contrast to normal paraffin which is electron neutral, wets the powder poorly and has little or no affinity for the powder surface. In addition to the above advantages of the wax mixture, it was found that by varying the composition of the esterified wax, the linear shrinkage of the sintered hardmetal article made from the powder can be controlled. It is to be understood that the content of esterified wax can vary within practical limits in order that the desired linear shrinkage can be attained. However, the usual content of esterified wax is from about 20% to about 80% by weight of the wax mixture. Within this range, the shrinkage in a tungsten carbide-cobalt article is normally reduced by up to about 1½% over the same type of articles made without the esterified wax component in the wax mixture when other conditions such as pressing parameters are constant.

The wax mixture is heated above the melting point of the mixture and the temperature is maintained above the melting point of the mixture.

A powder-wax mixture is formed consisting essentially of a metal carbide powder, a binder metal, and the above described wax mixture. Typically this powder-wax mixture consists essentially of about 1.75% to about 2.50% by weight wax mixture and the balance being the metal carbide and binder metal. Metal carbides that are especially suited to the practice of the invention are tungsten carbide, titanium carbide, tantalum carbide, vanadium carbide, molybdenum carbide, niobium carbide, chromium carbide, and combinations of these. Especially preferred is tungsten carbide. In the carbide powder component, one carbide can be the main component, and one or more of the other carbides can be present in minor amounts. For example, tungsten carbide can be the main component having minor amounts of constituents such as tantalum carbide, titanium carbide, vanadium carbide, niobium carbide, chromium carbide, molybdenum carbide, and combinations of these. The binder metal is typically cobalt, nickel or combinations of these. The wax mixture serves as a lubricant and binder to bind the carbide particles to the metal binder particles. The wax is normally in flaked form. The mixing is done typically in a steam jacketed mixer. Mixing is carried out until the wax mixture is completely melted and evenly distributed throughout the carbide and binder metal powders. After sufficient mixing time which depends on the type of equipment and the amount of material, the powder-wax mixture is cooled by closing off the steam lines and opening up the cold water lines. The mixer is allowed to operate during the cooling causing the powder-wax to remain as a fluffy powder and not clumps or chunks.

A slurry is then formed of the resulting powder-wax mixture and water. This is done normally in an attritor mill in preparation for the subsequent attritor milling. The slurry is typically about 80% by weight powder-wax mixture and the balance water, although this can vary.

The resulting slurry is then attritor milled. The water serves as the milling fluid. The milling time is sufficient to allow the complete mixing of the carbide, binder metal, and wax. The milling time can vary depending on the properties desired in the final densified article. However, normally the milling time is about 2 to about 12 hours depending on mill loading parameters. The attritor milling insures uniform mixing of the carbide and binder metal powders and the wax. With the waxes already affixed to the carbide and binder metal, there is little or no wax separation from the carbide during milling as the aqueous slurry is maintained below the melting point of the wax phase.

After the attritor milling step, the water is removed from the attritor milled powder-wax mixture, and the mixture is agglomerated. This is done typically by spray drying the slurry. This removes the water and allows the carbide-binder metal-wax to form a spherical shape. The resulting dry spherical powder/wax grade mix agglomerates are then ready to be processed by conventional methods to produce densified articles therefrom. These methods involve generally formation of a green article by methods such as standard punch and die compaction, and thereafter removing the wax, and sintering usually at about 1350° C. to about 1540° C.

The reduction in linear shrinkage brought about by the method of the present invention is a result of the wax protecting the carbide-metal binder during milling. This protection minimizes oxidation and decarburization during aqueous attritor milling. In water milling, the binder metal, especially cobalt is prone to oxidation and most metallic carbides will decarburize in water forming a methane-acetylene gas. These reactions produce powders with unbalanced chemistries. During subsequent sintering the loss of the oxygen volume in particular causes an increase in shrinkage. Additionally, the high tenacity of the esterified wax for the powder allows the wax to better coat and protect the powders. This improved coating prevents the wax from separating from the powder and thus minimizes the grinding of the carbide cyrstals. In other words, the improved wax prevents the generation of excessive quantities of "fines" which are associated with increased shrinkage. The advantage of lower or controlled shrinkage is that the consistency of shrinkage possible with the wax formulation of the present invention assures that the tooling and powder shrinkage match, thus lowering tool costs in design phase and the subsequent use.

FIG. 1 is a plot of percent of esterified wax in the wax mixture versus the linear shrinkage in densified tungsten carbide-cobalt articles made from the powder. The tungsten carbide contains minor amounts of TiC, TaC, VC, $Cr_7C_3$, and NbC as additives. The composition of the WC-Co mixture is about 3% to about 25% by weight cobalt and the balance being the tungsten carbide. The amount of wax mixture in the WC-Co-wax mixture is about 1.75 to 2.50 percent by weight. The powder is pressed at a constant pressure of about 12 tons per square inch. Other processing conditions are constant. Sintering temperature is about 1435° C. It can be see that when other conditions are constant, the shrinkage is reduced as the esterified wax content increases in the wax mixture. The total shrinkage is reduced up to about 1½% from the 20% to 80% level of esterified wax. It was found that the highest shrinkage occurs when no esterified wax is present.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing metal carbide grade powders, said method comprising:

a) forming a wax mixture consisting essentially of in percent by weight about 5 to about 15 paraffin oil, with the balance being an esterified wax and paraffin;

b) heating said wax mixture to a temperature above the melting point of said mixture to melt said wax mixture and maintain said wax mixture in the molten state;

c) forming a powder-wax mixture consisting essentially of metal carbide powder, a binder metal, and said wax mixture while heating said carbide powder, said metal binder and said wax mixture to a temperature above the melting point of said wax mixture to maintain said wax mixture in the molten state to result in a uniform distribution of said wax mixture on said carbide and binder metal particles;

d) forming a slurry of said powder-wax mixture and water;

e) attritor milling said slurry at a temperature below the melting point of said wax mixture; and f) removing water from the resulting attritor milled powder-wax mixture and agglomerating said attritor milled powder-wax mixture to produce said metal carbide grade powder wherein a densified article made therefrom exhibits less linear shrinkage than in articles made from carbide grade powder absent said esterified wax, said shrinkage decreasing as the content of said esterified wax in said wax mixture increases.

2. A method of claim 1 wherein said esterified wax is selected from the group consisting of beeswax, carnauba wax, candellila wax, and combinations thereof.

3. A method of claim 1 wherein said esterified wax makes up about 20% to about 80% by weight of said wax mixture.

4. A method of claim 1 wherein said carbide powder is selected from the group consisting of tungsten carbide, titanium carbide, tantalum carbide, vanadium carbide, molybdenum carbide, niobium carbide, chromium carbide, and combinations thereof.

5. A method of claim 1 wherein said binder metal is selected from the group consisting of cobalt, nickel, and combinations thereof.

* * * * *